US007351952B2

(12) United States Patent
Morita et al.

(10) Patent No.: US 7,351,952 B2
(45) Date of Patent: Apr. 1, 2008

(54) APPARATUS FOR CONTROLLING NEUTRON BEAM AND METHOD FOR MANUFACTURING THE SAME

(75) Inventors: Shinya Morita, Wako (JP); Hitoshi Ohmori, Wako (JP); Yutaka Yamagata, Wako (JP); Sei Moriyasu, Wako (JP); Hirohiko Shimizu, Wako (JP); Takayuki Oku, Wako (JP)

(73) Assignee: Riken, Saitama (JP)

( * ) Notice: Subject to any disclaimer, the term of this patent is extended or adjusted under 35 U.S.C. 154(b) by 157 days.

(21) Appl. No.: 10/516,449

(22) PCT Filed: Jun. 3, 2003

(86) PCT No.: PCT/JP03/07002

§ 371 (c)(1),
(2), (4) Date: Apr. 24, 2006

(87) PCT Pub. No.: WO03/102970

PCT Pub. Date: Dec. 11, 2003

(65) Prior Publication Data

US 2006/0226350 A1 Oct. 12, 2006

(30) Foreign Application Priority Data

Jun. 4, 2002 (JP) ..... 2002-162365

(51) Int. Cl.
*G21K 1/06* (2006.01)

(52) U.S. Cl. ..... 250/251; 250/505.1; 250/390.1

(58) Field of Classification Search ..... 250/251, 250/505.1, 390.1
See application file for complete search history.

(56) References Cited

U.S. PATENT DOCUMENTS 6,580,080 B1 * 6/2003 Shimizu et al. ..... 250/390.1

FOREIGN PATENT DOCUMENTS

| | | |
|---|---|---|
| EP | 1 035 422 A2 | 9/2000 |
| EP | 1 080 836 A2 | 3/2001 |
| JP | 2000-258598 | 9/2000 |
| JP | 2001-062691 | 3/2001 |

OTHER PUBLICATIONS

International Search Report, completed Jul. 23, 2003.

* cited by examiner

*Primary Examiner*—Kiet T. Nguyen
(74) *Attorney, Agent, or Firm*—Griffin & Szipl, P.C.

(57) ABSTRACT

An apparatus for controlling a neutron beam includes a plurality of columnar prisms 1 that are made of a material having a refractive index of less than 1 for a neutron beam, and are arranged so as to be multi-layered. The columnar prisms 1 each have an approximately right-triangle-shaped section, and are three-dimensionally multi-layered such that respective surfaces 1*a*, 1*b*, 1*c* of the columnar prisms are in parallel to one another. Stick-shaped members 5 are made of the above material, the stick-shaped members 5 are set in a plurality of grooves formed on a jig 6 that have the same shape, and upper surfaces of the grooves are flattened at the same time.

11 Claims, 9 Drawing Sheets

APPARATUS FOR CONTROLLING NEUTRON BEAM AND METHOD FOR MANUFACTURING THE SAME

This is a National Phase Application in the United States of International Patent Application No. PCT/JP03/07002 filed Jun. 3, 2003, which claims priority on Japanese Patent Application No. 162365/2002, filed Jun. 4, 2002. The entire disclosures of the above patent applications are hereby incorporated by reference.

BACKGROUND OF THE INVENTION

1. Field of the Invention

The present invention relates to a neutron beam controlling apparatus that performs converging and diverging of a neutron beam, and a method for manufacturing the same.

2. Description of the Related Art

A neutron beam is different from an X ray or a photon, and has the following characteristics. (1) The neutron beam strongly interferes with an atomic nucleus. (2) Energy and a wavelength of the neutron beam have the same degree as motion and a structure in a level of an atom. (3) The neutron beam has a magnetic moment. (4) The neutron beam has strong penetration power. By taking advantage of such characteristics of the neutron beam, in a case of research of position itself of an atomic nucleus, for example, in a case of obtaining position information of a hydrogen atom in an organic material, a scattering experiment that uses a neutron beam is inevitable because it is extremely difficult to obtain such position information by X-ray scattering. Furthermore, since a neutron has a ½ spin and a magnetic moment, the neutron beam is useful for examining a magnetic structure of a material. Further, in a case where research of an inside of a large object such as an industrial product is performed by using radiation, the neutron beam having strong penetration power enables fluoroscoping of the large object.

However, it is not easy to generate a neutron beam, so that a place where the neutron beam can be available is limited to a nuclear reactor, an accelerator facility and the like. For this reason, in order that the neutron beam is efficiently introduced from the neutron source to an apparatus using the neutron beam, and a minute sample is irradiated with the high-density neutron beam, a beam controlling technique for raising a degree of parallelization of the neutron beams and focusing the neutron beams is inevitable.

Recently, attention has been paid to above-described analyzing that uses the neutron beam, and the applicant of present patent application has already proposed a device for converging and diverging of the neutron beams (refer to "Japanese Laid-Open Patent Publication No. 2001-062691). Hereinbelow, this device is referred to as a "neutron lens").

FIG. 1 shows a principle of a refraction of a neutron beam by a substance. Almost interaction between a neutron and a substance is caused by interaction between the neutron and an atomic nucleus in the substance. Because of this interaction, when the incident neutron enters the inside of the substance, the neutron loses a part of its energy, so that the neutron is decelerated in the direction perpendicular to the boundary surface of the substance. Thereby, the neutron beam that obliquely enters the boundary surface of the substance is refracted such that a refractive index becomes a value smaller than 1 as shown in FIG. 1. A material that has a refractive index of less than 1 for a neutron beam includes oxygen O, carbon C, beryllium Be and fluorine F among those having naturally occurring isotopic concentrations, and deuterium D among enriched isotopes.

FIG. 2 shows a principle of a neutron lens, and shows a way in which a neutron beam 16 enters one plate member 11. Linear projections 12 each including an almost vertical surface 15 and an inclining surface 15 are formed on the plate member 11. The neutron beam 16 that enters the inclining surface 15 of the linear projection 12 is refracted such that a refractive index becomes lower than 1 similarly to FIG. 1. However, a refracted angle δ by this one refraction is minute. For example, when the plate member 11 is made of polytetrafluoroethylene (PTFE), and the inclining surface 15 of the linear projection 12 is inclined from a surface plane of the plate member 11 by an angle α of 45 degrees, an refracted angle of a neutron beam 16 that has a wavelength of 14 angstroms (Å) and vertically enters the plate member 11 is only 0.14 mrad.

FIG. 3 is a perspective view showing a neutron lens that has a function of focusing a neutron beam. FIG. 4 is a sectional view taken along the line A-A of FIG. 3. This neutron lens includes a body part 20, and upper and lower annular outer frames 21 and 22 that fix the body part 20. The body part 20 is sandwiched between the upper and lower annular outer frames 21 and 22, and the outer frames 21 and 22 are fixed on pins 23 arranged between the outer frames 21 and 22 by screws 24 so that the neutron lens can be assembled.

FIGS. 5A and 5B show a structure of a plate member 25 that constitutes the body part 20. To assemble the body part 20, many plate members 25 that each have a hole 32 at the center thereof are multi-layered. The plate member at the higher position has the larger hole at the center thereof, and the plate member at the bottom position does not have the hole at the center thereof. Accordingly, the body part 20 has cone-shaped hollow at the center. In the example of FIG. 4, the body part 20 is constituted by 33 plate members 25 that are multi-layered. The reference numerals 33*a* through 33*d* designate holes for pins 23.

In FIGS. 5A and 5B, annular protrusions 31 of which sections are triangle-shaped are formed successively on a thin plate in the radial direction of the thin plate to configure the plate member 25. An inclining surface 31*a* of the annular protrusion 31 has a triangle-shaped section, provides an incident surface inclined with respect to a beam axis of the incident neutron beam, and faces the inside of the concentric circles, that is, the center axis of the neutron lens.

The neutron beam that enters the neutron lens shown in FIGS. 4, 5A and 5B in parallel with the axis of the neutron lens obliquely enters the inclining surface of the annular protrusion 31 formed on the plate member. For this reason, the neutron beam is deflected toward the center axis of the neutron lens. A part of the neutron beam that enters the center part of the neutron lens penetrates through the relatively small number of the annular protrusions to be deflected by a small angle. On the other hand, a part of the neutron beam that enters the peripheral part of the neutron lens penetrates through the relatively large number of the annular protrusions to be deflected by a large angle. As a result, the neutron lens performs a function similar to that of a convex lens in an optical system, and thus, can focus the neutron beam on a minute region.

Contrary to the example of FIG. 5, if the inclining surfaces 31*a* of the annular protrusions 31 are formed to face the outer side of the concentric circles, the neutron lens can perform a function similar to that of a concave lens, and can force the neutron beam to diverge with the same configuration as that of FIG. 4.

As described above, the plate member 25 need be made of a material that has a refraction index of less than 1 for a neutron beam. This material includes oxygen O, carbon C, beryllium Be and fluorine F among those having naturally occurring isotopic concentrations, and deuterium D among enriched isotopes. Specifically, the material of the plate member 25 is polytetrafluoroethylene. (PTFE), quartz, $MgF_2$, lead glass, glassy carbon, polyethylene deuteride formed by replacing hydrogen of polyethylene with deuterium, or the like.

Among these materials, quartz, $MgF_2$, lead glass, and glassy carbon (hereinbelow, simply referred to as carbon) are relatively easily available, and desirably, the plate member is formed from the carbon plate.

However, the carbon is hard and fragile, so that the edge part of the annular protrusion is broken by usual machining such as cutting. For this reason, there is a problem in that the material cannot be machined to have a desired shape. In other words, since it is necessary to form the neutron lens by multi-layering many plate members 25, the thinner plate member 25 is better to downsize the neutron lens. For example, desirably, the plate member 25 is about 1 mm in thickness. However, if carbon plate is made thin, the carbon plate is broken by a slight machining resistance. Furthermore, to accurately deflect the neutron beam, it is necessary to raise accuracy of the inclining surface 31*a* of the annular protrusion 31. In addition, to increase penetration efficiency of the neutron beam while suppressing diffused reflection of the neutron beam on the surface of the neutron lens, the inclining surface 31*a* need be finished to have a surface roughness near a mirror surface.

In order to solve the above problems, the inventor of the present invention et al devised a method for machining a neutron lens and filed a patent application of this method (refer to Japanese Laid-Open Patent Publication No. 2001-062691). According to this method, as schematically shown in FIG. 6, one or more tapered surfaces 33*a* of a grinding wheel makes with each other an angle that is sharper than an angle of a V-shaped groove formed on the surface of the neutron lens member 32. The grinding wheel 33 is positioned by a grinding wheel driving machine 34 such that the axis of the grinding wheel 33 is tilted from the rotational axis of the neutron lens member 32. At this position, the tilting angle of the axis of the grinding wheel is changed such that the grinding wheel slightly swings.

However, in this machining method, it is difficult to avoid change of a sectional shape of the tool caused by frictional wear. As a result, sectional shapes of the minute grooves are changed, and thereby, it also becomes difficult to control a surface roughness of the optical surface of the device. Consequently, neutron beam controlling performance of the device is lowered, a cost for correcting the changed shape of the tool is required, and machining efficiency is deteriorated.

SUMMARY OF THE INVENTION

In order to solve the above problems, the present invention was made. It is an object of the present invention to provide a neutron beam controlling apparatus that can efficiently perform converging and diverging of a neutron beam, wherein the neutron beam controlling apparatus is made of a material (for example, hard and fragile glassy carbon) having a refractive index of less than 1 for a neutron beam. It is also an object of the present invention to provide a method for manufacturing the neutron beam controlling apparatus.

According to the present invention, there is provided an apparatus for controlling a neutron beam, comprising a plurality of columnar prisms (1) that are made of a material having a refractive index of less than 1 for a neutron beam, and are arranged so as to be multi-layered.

Thereby, the columnar prisms can be machined so as to have the sectional surfaces and the surface roughness of the respective columnar prisms with high accuracy and/or high quality. It is possible, therefore, to configure the neutron lens that does not have a rounded part and a broken part at an end portion and an acute-angled portion of the neutron lens.

According to a preferred embodiment of the present invention, the columnar prisms 1 each have an approximately right-triangle-shaped section, and are three-dimensionally multi-layered such that respective surfaces (1*a*, 1*b*, 1*c*) of the columnar prisms are in parallel to one another.

Thereby, it is possible to deflect the neutron beam that passes through two surfaces (1*a*, 1*b*) of each columnar prism (1). Accordingly, a plurality of the multi-layered columnar prisms can repeatedly deflect the neutron beam. As a result, the neutron beam can be largely deflected.

Preferably, oblique surfaces of the multi-layered columnar prisms are in parallel to one another, and face in the same direction so as to approximately form a triangular prism as a whole. Thereby, a part of the neutron beam that enters a low-height part of the triangular prism (2) passes through the relatively small number of the columnar prisms (1) so as to be deflected by a small angle. On the other hand, a part of the neutron beam that enters a high-height part of the triangular prism (2) passes through the relatively large number of the columnar prisms (1) so as to be deflected by a large angle. In this manner, the triangular prism (2) performs a function similar to that of a convex lens in an optical system, and thus, can focus the neutron beam on a minute region.

Furthermore, the apparatus for controlling the neutron beam preferably comprises a plurality of the above-mentioned triangular prisms arranged such that oblique surfaces respectively constituting the triangular prisms cross each other. Thereby, a plurality of the triangular prisms can focus the neutron beam on a minute region so as to multiply intensity of the neutron beam.

Preferably, the columnar prisms 1 each have an approximately right-triangle-shaped section, the apparatus for controlling the neutron beam comprises a plurality of horizontal prism plates (3) each of which includes the columnar prisms horizontally arranged such that respective surfaces (1*a*, 1*b*, 1*c*) of the columnar prisms are in parallel to one another, and the plurality of horizontal prism plates are vertically multi-layered so as to be horizontally turned alternately by 90 degrees. Thereby, it is possible to deflect the neutron beam alternately in the different directions that differ by 90 degrees. As a result, it is possible to focus the neutron beam on one point as a whole.

Further, the apparatus for controlling the neutron beam preferably comprises a positioning member that sets the plurality of columnar prisms at predetermined positions, respectively. By the positioning member (4), it is possible to easily set a plurality of the columnar prisms at predetermined positions, respectively.

According to the present invention, there is also provided a method for manufacturing a neutron beam controlling apparatus, comprising: forming a plurality of columnar prisms that are made of a material having a refractive index of less than 1 for a neutron beam, and each have an approximately right-triangle-shaped section; and three-dimensionally multi-layering the plurality of columnar prisms such that respective surfaces of the columnar prisms are in parallel to one another.

According to a preferred embodiment of the present invention, the forming of the plurality of columnar prisms is performed by any of molding, extruding, cutting, grinding, whetting or any combination thereof.

Thereby, the columnar prisms can be machined so as to have the sectional surfaces and the surface roughness of the respective columnar prisms with high accuracy and/or high quality. It is possible, therefore, to configure the neutron lens that does not have a rounded part and a broken part at an end portion and an acute-angled portion of the neutron lens.

In addition, forming the plurality of prisms preferably comprises: making stick-shaped members (5) of the above-mentioned material; setting the stick-shaped members (5) in a plurality of grooves formed on a jig (6), the grooves having the same shape; and flattening upper surfaces of the grooves at the same time.

Preferably, the flattening of the upper surfaces of the grooves is performed by ELID grinding.

By this flattening process, it is possible to efficiently form the columnar prisms (1) that have the same shape and do not have a rounded part and a broken part.

Furthermore, preferably, the flattening of the upper surfaces of the grooves is performed by a straight grinding wheel, a cup grinding wheel or a lap. By the application of the ELID grinding, it is possible to form the columnar prisms (1) of which surfaces have a surface roughness of a high quality near that of a mirror surface.

Other object and advantageous features of the present invention will become apparent from the following description with reference to the attached drawings.

DESCRIPTION OF THE PREFERRED EMBODIMENTS

Figure 1:
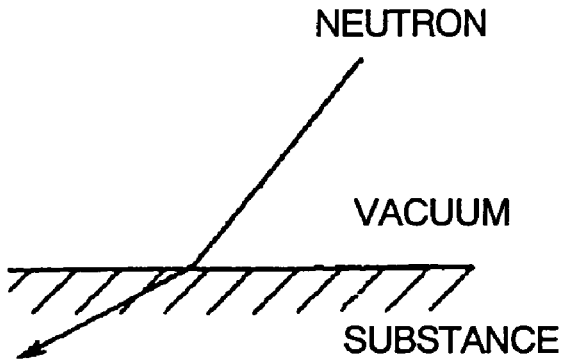
FIG. 1 shows a principle of refraction of a neutron beam by a material.
Figure 2:
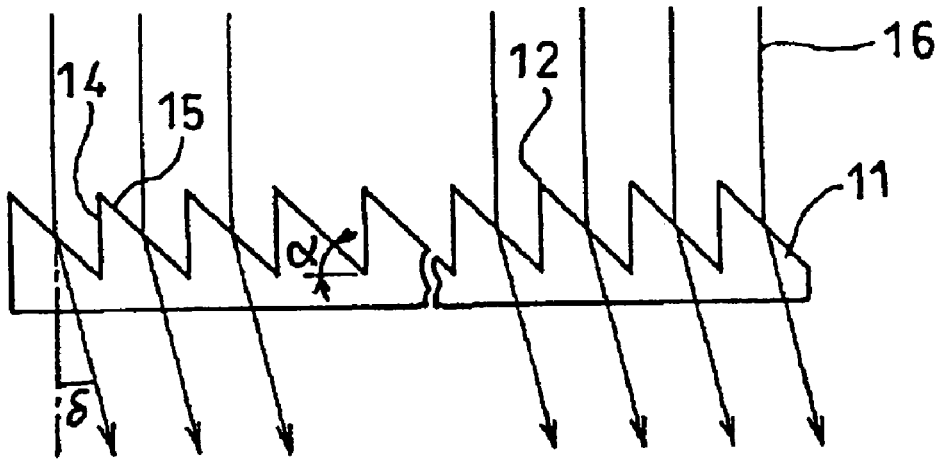
FIG. 2 shows a principle of a neutron lens.
Figure 3:
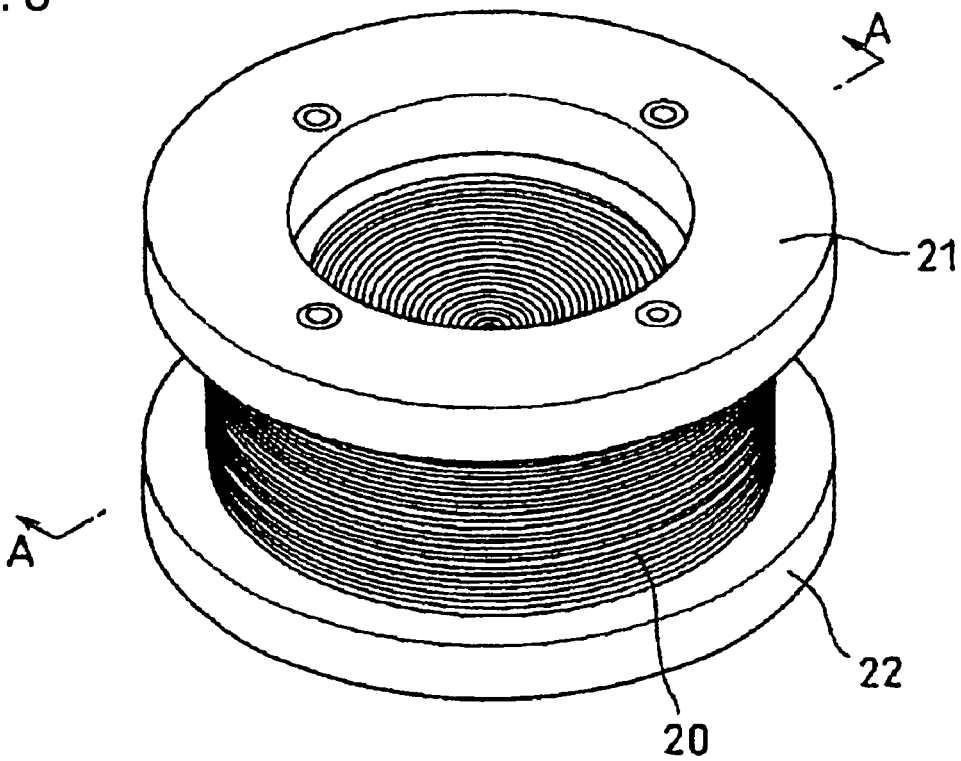
FIG. 3 is a perspective view showing a neutron lens that has a function of focusing a neutron beam.
Figure 4:
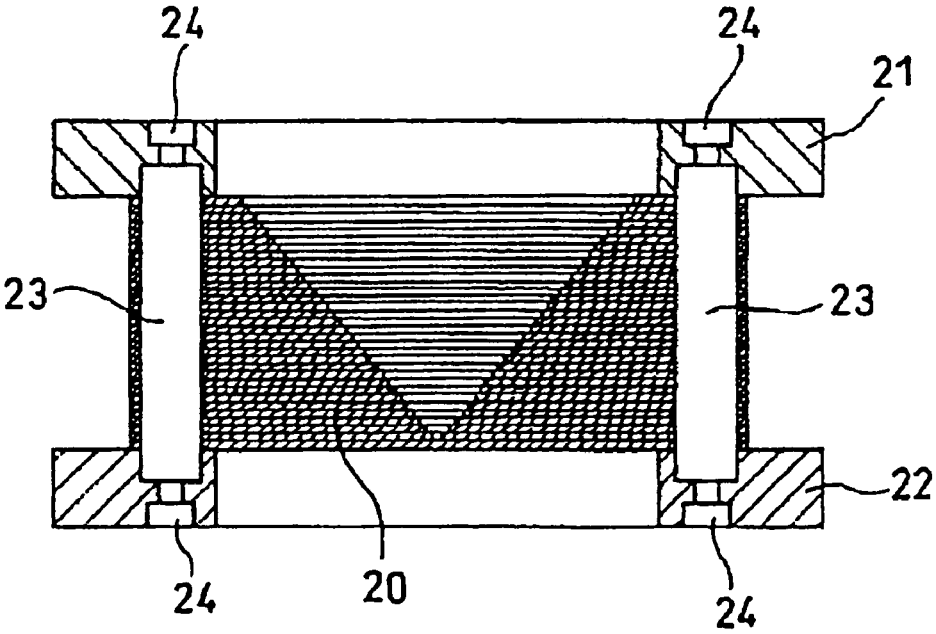
FIG. 4 is a sectional view taken along the line A-A of FIG. 3.
Figure 5A:
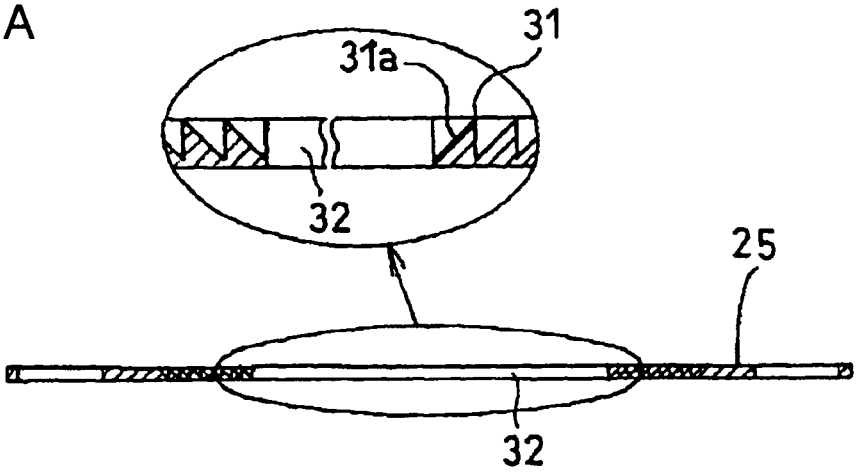
FIGS. 5A and 5B show a configuration of a plate member constituting a body shown in FIG. 4.
Figure 5B:
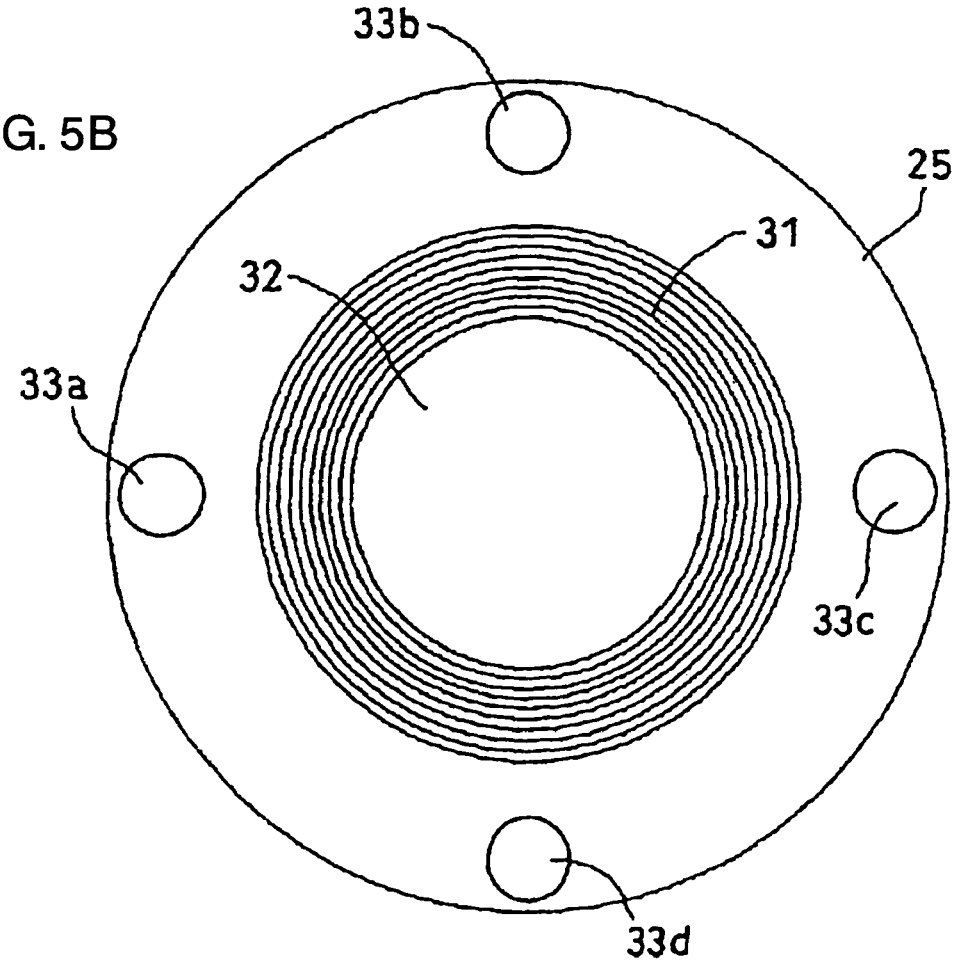
Figure 6:
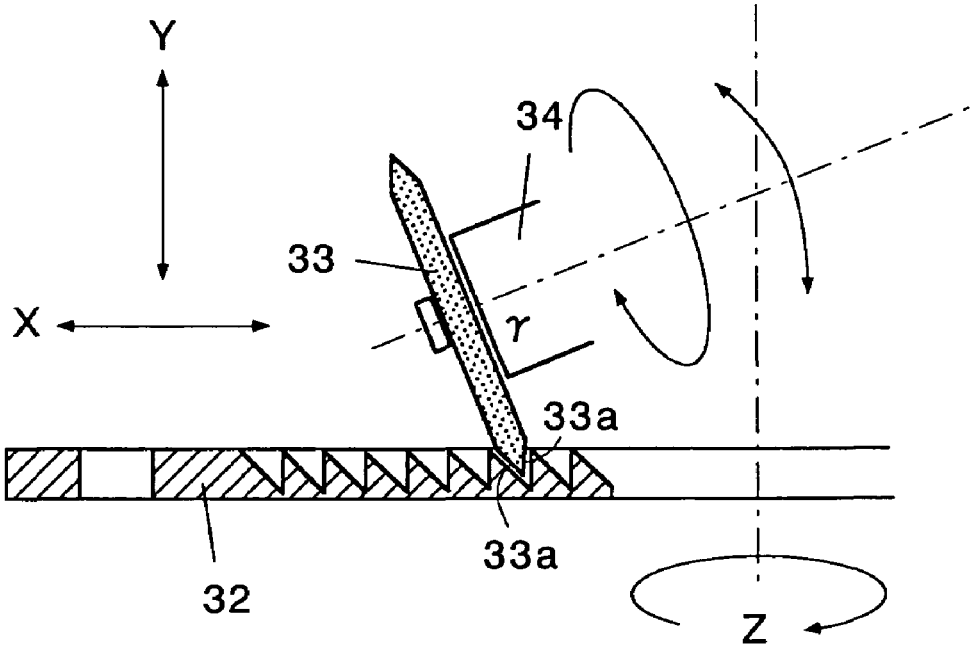
FIG. 6 schematically shows a neutron lens machining method that is not opened to the public.

In the following, embodiments of the present invention will be described with reference to the drawings. In the drawings, the same reference numeral is attached to the common part or element, and the overlapping description is omitted.

Figure 7A:
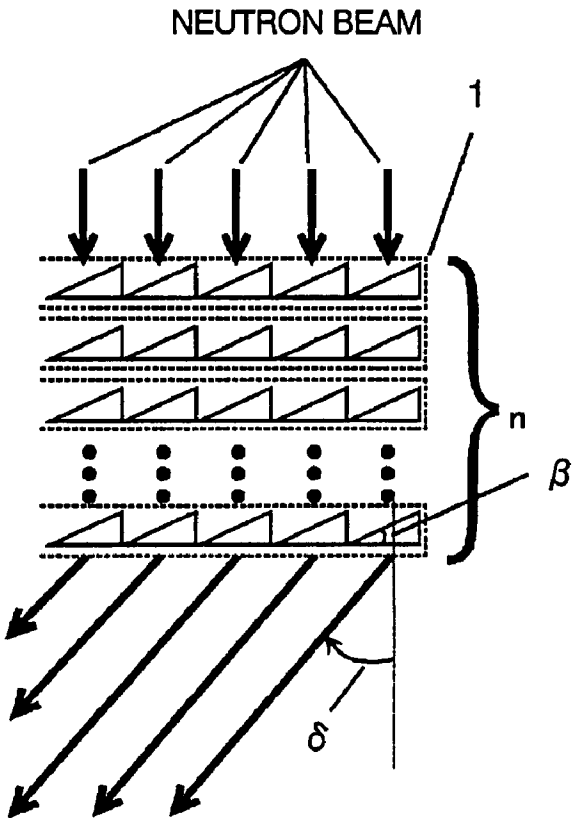
FIGS. 7A, 7B, 7C and 7D show a principle of an apparatus for controlling a neutron beam according to the present invention.
Figure 7B:
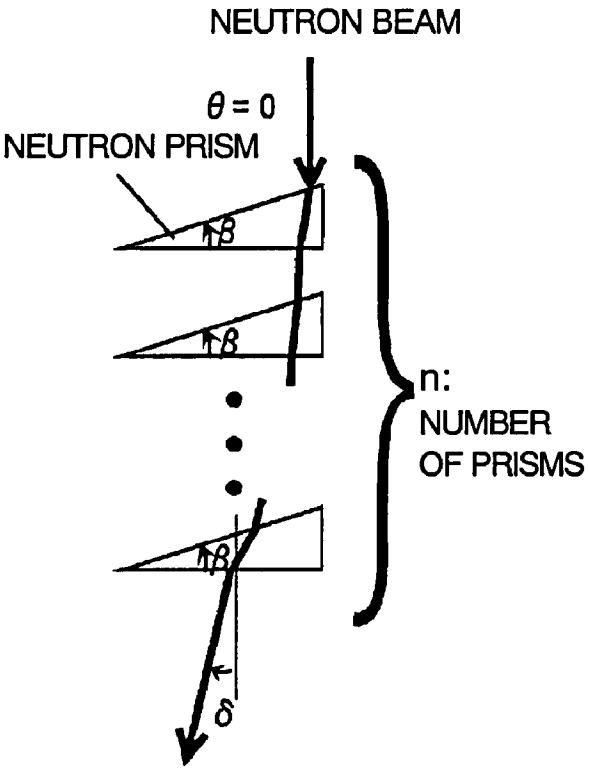
Figure 7C:
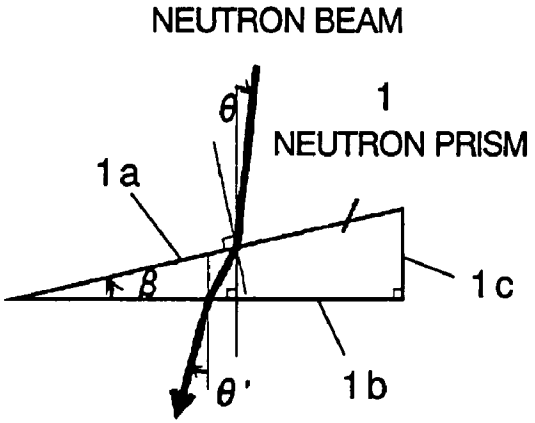
Figure 7D:
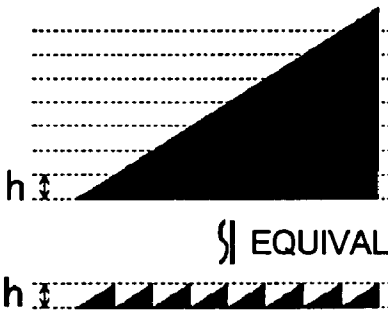

FIGS. 7A, 7B, 7C and 7D show a principle of an apparatus for controlling a neutron beam according to the present invention. FIG. 7A shows the entire configuration of the apparatus, FIG. 7B is the operational illustration, FIG. 7C is the single operational illustration, and FIG. 7D shows the effect.

As shown in these drawings, the neutron beam controlling apparatus includes a plurality of columnar prisms 1 (neutron prisms in the drawings). The columnar prism 1 is made of a material having a refractive index of less than 1 for a neutron beam. The material of the columnar prism 1 includes oxygen O, carbon C, beryllium Be and fluorine F among those having naturally occurring isotopic concentrations, and deuterium D among enriched isotopes. Specifically, the material of the columnar prism 1 includes polytetrafluoroethylene (PTFE), quartz, $MgF_2$, lead glass, glassy carbon, and polyethylene deuteride formed by replacing hydrogen of polyethylene with deuterium. Hereinbelow, the material having a refractive index of less than 1 for the neutron beam is referred to as "neutron deflecting material".

The section of the columnar prism 1 is approximately right-triangle-shaped. The columnar prisms 1 are three-dimensionally multi-layered such that sides 1*a*, 1*b* and 1*c* of the triangles of the prisms 1 are respectively in parallel to one another.

An angle β that the oblique surface (or side) 1*a* makes with the bottom surface (or side) 1*c* is arbitrary. The angle β enables the neutron beam to be deflected toward the oblique surface 1*a* as shown in FIG. 7C. This deflection angle (θ'−θ is slight, but a large number of layers of prisms 1 ("n" number of layers in the drawings) are multi-layered so that a large deflection angle δ as a whole can be obtained as shown in FIGS. 7A and 7B.

Further, horizontal arranging of the columnar prisms 1 achieves the deflecting performance equal to that of a single large prism as shown in FIG. 7D, and an amount of neutrons absorbed by the material can be reduced.

Figure 8A:
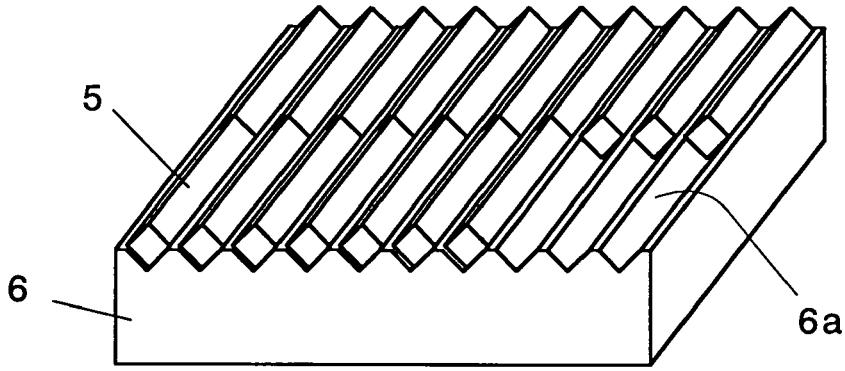
FIGS. 8A and 8B schematically shows a manner of shaping columnar prisms according to the present invention.
Figure 8B:
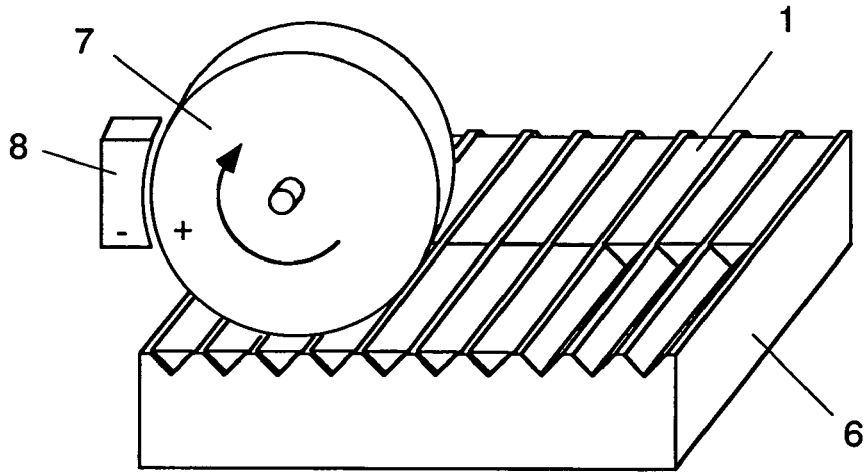
Figure 9A:
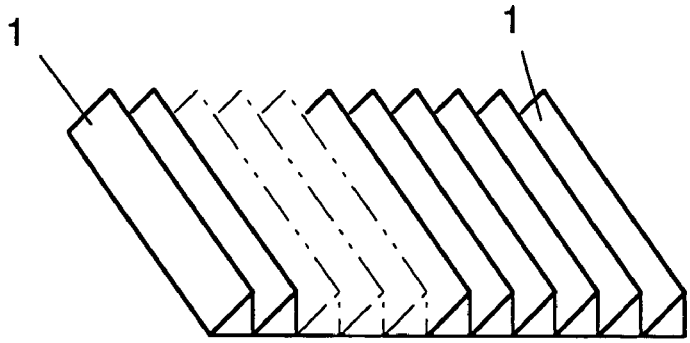
FIGS. 9A, 9B and 9C schematically show a manner of multi-layering the columnar prisms according to the present invention.
Figure 9B:
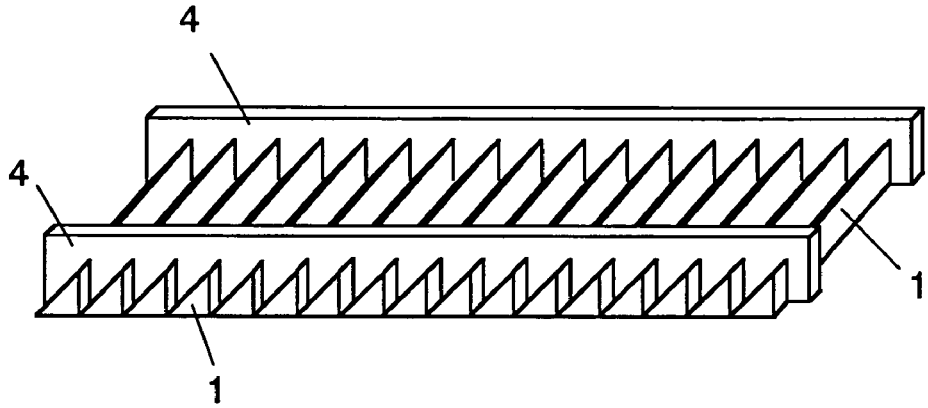
Figure 9C:
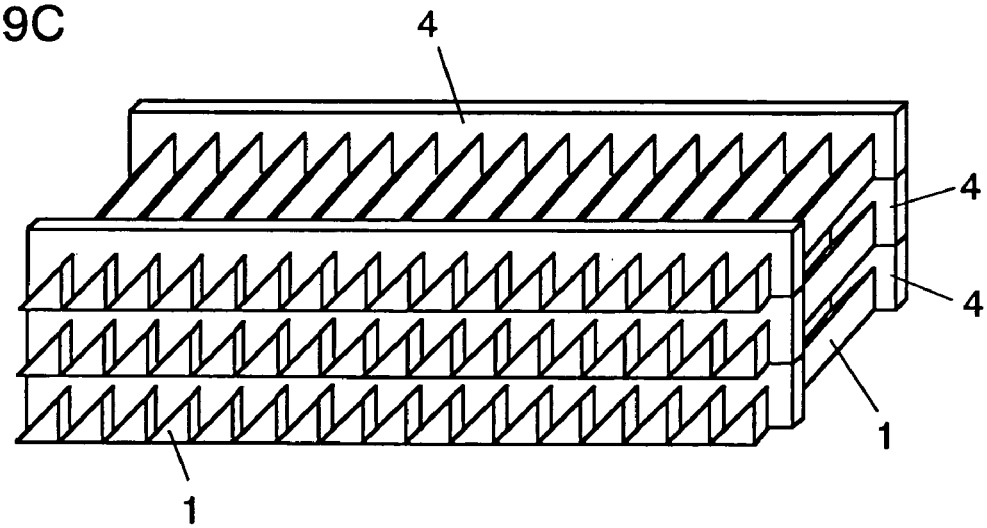

FIGS. 8A and 8B schematically show one example of a manner of shaping columnar prisms according to the present invention. FIGS. 9A, 9B and 9C schematically show one example of a manner of multi-layering columnar prisms according to the present invention.

As shown in FIGS. 8A, 8B, 9A, 9B and 9C, a method for manufacturing the neutron beam controlling apparatus according to the present invention includes a shaping step of shaping a plurality of columnar prisms 1 that are made of the neutron deflecting material and have an approximately right-triangle-shaped section. Further, the method for manufacturing the neutron beam controlling apparatus includes a multi-layering step of three-dimensionally multi-layering columnar prisms 1 such that the surfaces of the columnar prisms are respectively in parallel to one another.

In the shaping step, stick-shaped members 5 are made of the neutron deflecting material. To make the stick-shaped members 5 of the neutron deflecting material, any of molding, extruding, cutting, grinding and whetting or any combination thereof may be performed.

Next, as shown in FIG. 8A, the stick-shaped members 5 are respectively set in a plurality of grooves 6*a* that have the same shape and are formed on a jig 6. At this time, if necessary, an adhesive agent or the like may be used.

Thereafter, as shown in FIG. 8B, flattening is simultaneously performed on upper surfaces (parts) of the respective grooves 6*a*.

In FIG. 8B, the reference numeral 7 designates an ELID grinding wheel, and the reference numeral 8 designates an ELID electrode. In other words, in this example, to form oblique surfaces la of the columnar prisms 1, electrolytic in-process dressing grinding (ELID grinding) is performed by applying an electrolyzing voltage between the grinding wheel 7 and the electrode 8 while supplying conductive grinding liquid between the grinding wheel 7 and the electrode 8. The ELID grinding is also performed for the other surfaces 1*b* and 1*c* by using other jigs 6.

Thereby, the ELID grinding wheel 7 always having an optimum toothed state can be used even when the ELID grinding wheel 7 includes ultra-minute grinding particles. Furthermore, by the ELID grinding, the machining can be performed at a low machining resistance, at high efficiency, with high accuracy, and it is possible to achieve mirror surfaces having fine surface roughness.

The grinding wheel 7 in FIG. 8B is not limited to a straight grinding wheel, and may be a cup grinding wheel. Further, instead of machining by the grinding wheel 7, lapping may be performed by using a lap. The shaping step is not limited to the ELID grinding, and may be any of molding, extruding cutting, grinding and whetting, or any combination thereof for forming the columnar prisms 1 from the neutron deflecting material.

Next, in the multi-layering step, by using a positioning member 4 shown in FIG. 9B, the respective columnar prisms 1 are set at predetermined positions. A material (for example, aluminum) having high permeability for a neutron is used as a material of the positioning member 4. After the respective columnar prisms 1 are set in each positioning member 4, the positioning members 4 are multi-layered so that the columnar prisms 1 can be three-dimensionally multi-layered as shown in FIG. 9C. The positioning member 4 is not inevitable, and the multi-layering of the columnar prisms 1 may be performed without using the positioning member 4 in accordance with a necessity.

Figure 10:
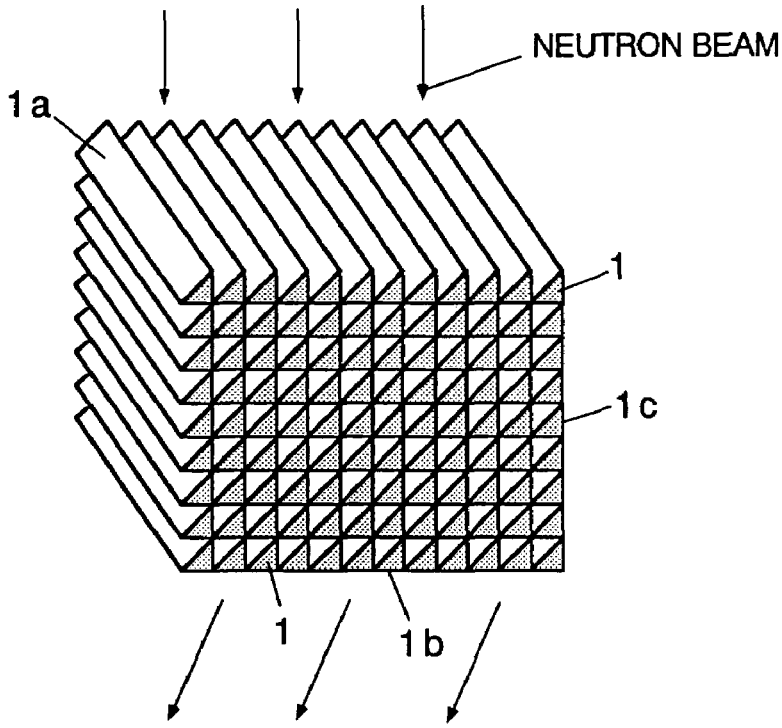
FIG. 10 shows a first embodiment of an apparatus for controlling a neutron beam according to the present invention.

FIG. 10 shows a first embodiment of the neutron beam controlling apparatus according to the present invention. In FIG. 10, the section of each columnar prism 1 is approximately right-triangle-shaped. The columnar prisms 1 are horizontally and vertically multi-layered such that the surfaces 1*a*, 1*b* and 1*c* of the prisms 1 are respectively in parallel to one another. In this manner, an entire cubic block is formed. There are gaps between the columnar prisms 1, and if necessary, the gaps may be filled with inert gas, or be held in a vacuumized state. Alternatively, the gaps may be filled with a material that does not absorb a neutron beam to fix the columnar prisms 1.

With this configuration, by a plurality of columnar prisms 1, a neutron beam that passes through the surfaces 1*a* and 1*b* of the columnar prisms 1 can be repeatedly deflected. As a result, it is possible to largely deflect the neutron beam.

Figure 11:
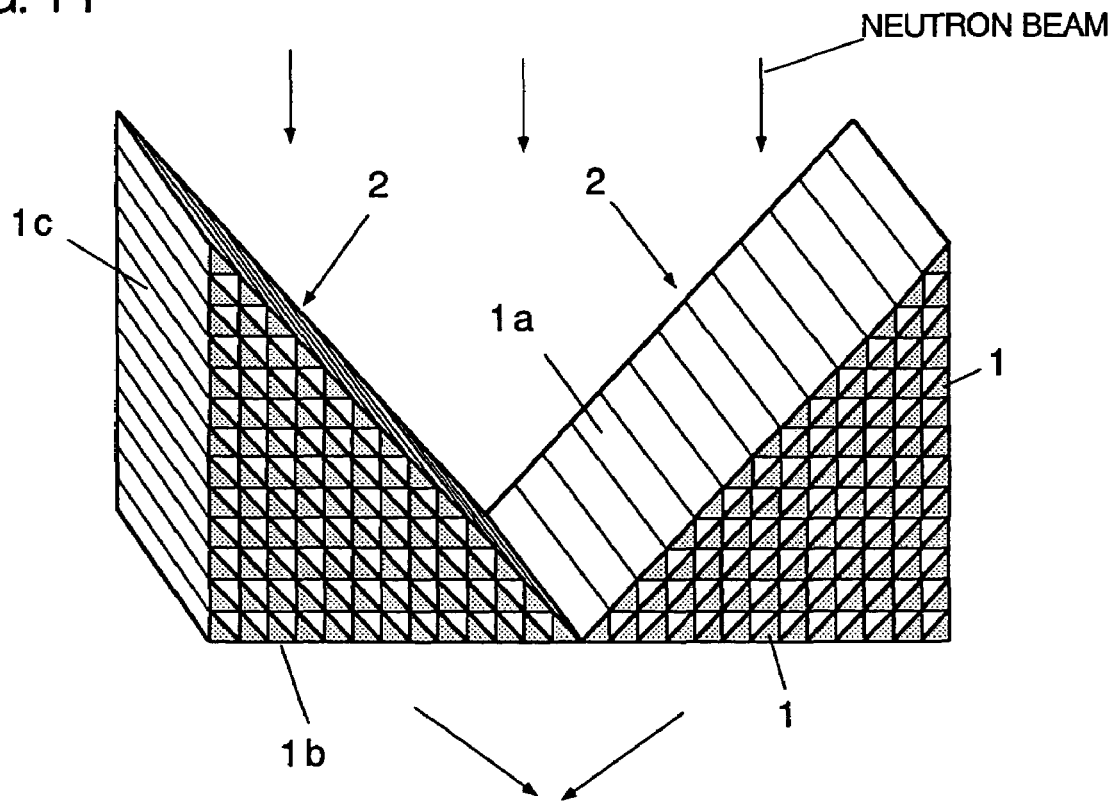
FIG. 11 shows a second embodiment of an apparatus for controlling a neutron beam according to the present invention.

FIG. 11 shows a second embodiment of the neutron beam controlling apparatus according to the present invention. In FIG. 11, the columnar prisms 1 are multi-layered such that the oblique surfaces 1*a* of the right triangles of the columnar prisms 1 are in parallel to one another, and face in the same direction. In this manner, the columnar prism 1 constitutes an entire triangular prism 2. In this example, the neutron beam controlling apparatus includes two triangular prisms 2 that are arranged such that oblique surfaces of the triangular prisms 2 constituted by the oblique surfaces 1*a* of the prisms 1 crosses each other.

With this configuration, the triangular prisms 2 can focus the neutron beam on a minute region to multiply intensity of the neutron beam.

Figure 12:
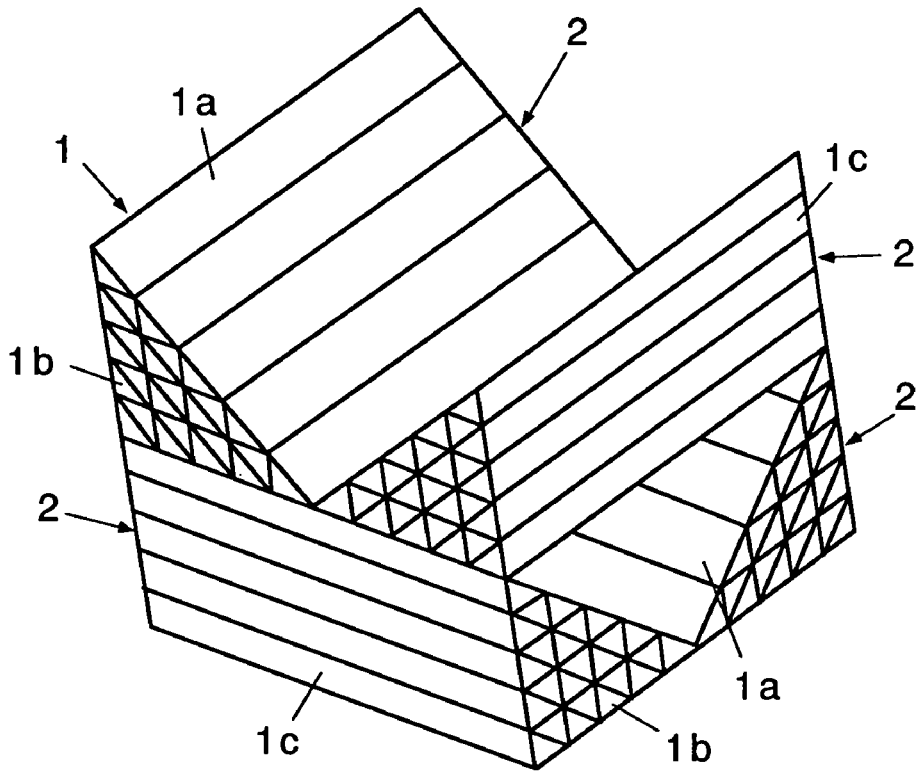
FIG. 12 shows a third embodiment of an apparatus for controlling a neutron beam according to the present invention.

FIG. 12 shows a third embodiment of the neutron beam controlling apparatus according to the present invention. In FIG. 12, the neutron beam controlling apparatus includes four triangular prisms 3 similar to or same as that of FIG. 11. Two triangular prisms 3 at the lower side of FIG. 12 are arranged such that the oblique surfaces of the triangular prisms 3 constituted by the oblique surfaces 1*a* of the prisms 1 cross each other. The triangular prisms 3 at the upper side are arranged so as to be turned by 90 degrees from the triangular prisms 2 at the lower side.

With this configuration, the neutron beam can be deflected alternately in the different directions that differ by 90 degrees. In this manner, the entire neutron beam controlling apparatus can focus the neutron beam on one point.

As described above, the present invention has the following advantages.

(1) The machining of the columnar prisms can be performed such that the sectional surfaces and the surface roughness of the columnar prisms have high accuracy and/or high quality. It is possible, therefore, to configure the neutron lens that does not have a rounded part and a broken part at the end portion and an acute-angled bottom portion of the neuron lens.

(2) The multi-layered columnar prisms 1 can perform the same function as that of a convex lens in an optical system so as to focus the neutron lens on a minute region. It is possible, therefore, to multiply the intensity of the neutron beam, and to further focus the neutron beam on one point.

(4) Use of the positioning member 4 enables a plurality of columnar prisms to be easily set at predetermined positions.

(5) The machining of the columnar prisms 1 can be relatively easily machined at high efficiency such that the sectional shape and the surface roughness of each columnar prism 1 have high accuracy and/or high quality. It is possible, therefore, to configure the neutron lens that does not have a rounded part and a broken part at the end portion and the acute-angled bottom portion of the neuron lens.

Thus, according to the neutron beam controlling apparatus and the method for manufacturing the same, the neutron beam controlling apparatus is configured by a material having a refractive index of less than 1 for a neutron beam. An example of the material is hard and fragile glassy carbon. Thereby, the neutron beam controlling apparatus has an excellent advantage to efficiently perform converging or diverging of the neutron beam.

The present invention is described in the above by the several preferred embodiments. However, it can be understood that the scope of the present invention is not limited to these embodiments. Thus, the scope of the present invention includes all improvements, modifications and equivalents that do not depart from the scope of claims.

What is claimed is:

1. An apparatus for controlling a neutron beam, comprising a plurality of columnar prisms that are made of a material having a refractive index of less than 1 for a neutron beam, and are arranged so as to be multi-layered.

2. An apparatus for controlling a neutron beam according to claim 1, wherein the columnar prisms 1 each have an approximately right-triangle-shaped section, and are three-dimensionally multi-layered such that respective surfaces of the columnar prisms are in parallel to one another.

3. An apparatus for controlling a neutron beam according to claim 2, wherein oblique surfaces of the multi-layered columnar prisms are in parallel to one another, and face in the same direction so as to approximately form a triangular prism as a whole.

4. An apparatus for controlling a neutron beam according to claim 3, comprising a plurality of said triangular prisms arranged such that oblique surfaces respectively constituting the triangular prism cross each other.

5. An apparatus for controlling a neutron beam according to claim 1, wherein the columnar prisms 1 each have an approximately right-triangle-shaped section, the apparatus for controlling the neutron beam comprises a plurality of horizontal prism plates each of which includes the columnar prisms horizontally arranged such that respective surfaces of the columnar prisms are in parallel to one another, and the plurality of horizontal prism plates are vertically multi-layered so as to be horizontally turned alternately by 90 degrees.

6. An apparatus for controlling a neutron beam according to claim 1, comprising a positioning member that sets the plurality of columnar prisms at predetermined positions, respectively.

7. A method for manufacturing a neutron beam controlling apparatus, comprising:

forming a plurality of columnar prisms that are made of a material having a refractive index of less than 1 for a neutron beam, and each have an approximately right-triangle-shaped section; and three-dimensionally multi-layering the plurality of columnar prisms such that respective surfaces of the columnar prisms are in parallel to one another.

8. A method for manufacturing a neutron beam controlling apparatus according to claim 7, wherein the forming of the plurality of columnar prisms is performed by any of molding, extruding, cutting, grinding, whetting or any combination thereof.

9. A method for manufacturing a neutron beam controlling apparatus according to claim 7, wherein forming the plurality of prisms comprising:

making stick-shaped members of said material;

setting the stick-shaped members in a plurality of grooves formed on a jig, the grooves having the same shape; and flattening upper surfaces of the grooves at the same time.

10. A method for manufacturing a neutron beam controlling apparatus according to claim 9, wherein the flattening of the upper surfaces of the grooves is performed by ELID grinding.

11. A method for manufacturing a neutron beam controlling apparatus according to claim 9, wherein the flattening of the upper surfaces of the grooves is performed by a straight grinding wheel, a cup grinding wheel or a lap.

* * * * *